US009403376B2

(12) United States Patent
Noda et al.

(10) Patent No.: US 9,403,376 B2
(45) Date of Patent: Aug. 2, 2016

(54) THERMAL HEAD AND THERMAL PRINTER EQUIPPED WITH THE THERMAL HEAD

(71) Applicant: KYOCERA Corporation, Kyoto-shi, Kyoto (JP)

(72) Inventors: Ayumi Noda, Kyoto (JP); Tadashi Mitsuoka, Kyoto (JP); Yasumitsu Yamamoto, Kyoto (JP)

(73) Assignee: Kyocera Corporation, Kyoto-Shi, Kyoto (JP)

( * ) Notice: Subject to any disclaimer, the term of this patent is extended or adjusted under 35 U.S.C. 154(b) by 0 days.

(21) Appl. No.: 14/655,544

(22) PCT Filed: Dec. 26, 2013

(86) PCT No.: PCT/JP2013/084816

§ 371 (c)(1),
(2) Date: Jun. 25, 2015

(87) PCT Pub. No.: WO2014/104170

PCT Pub. Date: Jul. 3, 2014

(65) Prior Publication Data

US 2015/0352858 A1 Dec. 10, 2015

(30) Foreign Application Priority Data

Dec. 28, 2012 (JP) ..... 2012-286796

(51) Int. Cl.
*B41J 2/335* (2006.01)

(52) U.S. Cl.
CPC ..... *B41J 2/3352* (2013.01); *B41J 2/335* (2013.01); *B41J 2/3351* (2013.01); *B41J 2/3353* (2013.01); *B41J 2/3357* (2013.01)

(58) Field of Classification Search
CPC ..... B41J 2/35; B41J 2/355; B41J 2/3551; B41J 2/3555; B41J 2/3558; B41J 2/3553; B41J 2/3556
USPC ..... 347/211, 215, 218, 221, 5, 14, 16; 358/1.5
See application file for complete search history.

(56) References Cited

U.S. PATENT DOCUMENTS

| | | | |
|---|---|---|---|
| 6,331,868 | B1 | 12/2001 | Yamade et al. |
| 2005/0162506 | A1 | 7/2005 | Terao et al. |

FOREIGN PATENT DOCUMENTS

| | | | |
|---|---|---|---|
| JP | 59-110650 | U | 7/1984 |
| JP | 62-028542 | U | 2/1987 |
| JP | 01-281956 | A | 11/1989 |
| JP | 03-227662 | A | 10/1991 |
| JP | 04-071256 | U | 6/1992 |
| JP | 08-099421 | A | 4/1996 |
| JP | 2005-205839 | A | 8/2005 |
| WO | 00/48839 | A1 | 8/2000 |

OTHER PUBLICATIONS

International Search Report, PCT/JP2013/084816, Apr. 8, 2014, 2 pgs.

*Primary Examiner* — Kristal Feggins
(74) *Attorney, Agent, or Firm* — Volpe and Koenig, P.C.

(57) ABSTRACT

A thermal head capable of decreasing the possibility of causing wrinkles in a recording medium is provided. A thermal head includes: a substrate; a heat generating portion disposed on the substrate; a driving IC disposed on the substrate and controlling actuation of the heat generating portion; a covering member covering the driving IC; and a projection portion disposed on the substrate and making contact with a recording medium. The substrate includes a first region and a second region in a plan view, the first region being defined by extending an area where the driving IC is disposed in a sub scanning direction and the second region being an area other than the first region. The projection portion is disposed on the second region closer to the heat generating portion than the area where the driving IC is disposed.

15 Claims, 8 Drawing Sheets

(a)

(b)

THERMAL HEAD AND THERMAL PRINTER EQUIPPED WITH THE THERMAL HEAD

TECHNICAL FIELD

The present invention relates to a thermal head and a thermal printer equipped with the thermal head.

BACKGROUND ART

Various types of thermal heads have been proposed to date as printing devices for use in facsimiles, video printers, and so forth. For example, there is known a thermal head comprising: a substrate; a heat generating portion disposed on the substrate; a driving IC which controls actuation of the heat generating portion; and a covering member which covers the driving IC, the covering member serving also as an ink ribbon guide, in which a recording medium is conveyed while making contact with the covering member (refer to Patent Literature 1, for example). Moreover, when the substrate is seen in a plan view, this thermal head is composed of a first region defined by extending an area where the driving IC is disposed in a sub scanning direction, and a second region being an area other than the first region.

CITATION LIST

Patent Literature

Patent Literature 1: Japanese Unexamined Patent Publication JP-A 01-281956 (1989)

SUMMARY OF INVENTION

Technical Problem

In the thermal head as above described, however, the height of the second region free of the driving IC is lower than the height of the first region, thus causing poor contacting condition between a recording medium and the thermal head, which gives rise to the possibility of occurrence of wrinkles in the recording medium.

Solution to Problem

A thermal head in accordance with one embodiment of the invention comprises: a substrate; a heat generating portion disposed on the substrate; a driving IC disposed on the substrate and controlling actuation of the heat generating portion; a covering member covering the driving IC; and a projection portion disposed on the substrate and making contact with a recording medium under conveyance. Moreover, the substrate comprises a first region and a second region in a plan view, the first region being defined by extending an area where the driving IC is disposed in a sub scanning direction and the second region being an area other than the first region. In addition, the projection portion is disposed on the second region closer to the heat generating portion than the area where the driving IC is disposed.

A thermal printer in accordance with one embodiment of the invention comprises: the thermal head as described above; a conveyance mechanism conveying the recording medium onto the heat generating portion; and a platen roller pressing the recording medium onto the heat generating portion.

Advantageous Effects of Invention

According to the invention, the possibility of causing wrinkles in a recording medium can be decreased.

DESCRIPTION OF EMBODIMENTS

<First Embodiment>

Figure 1:
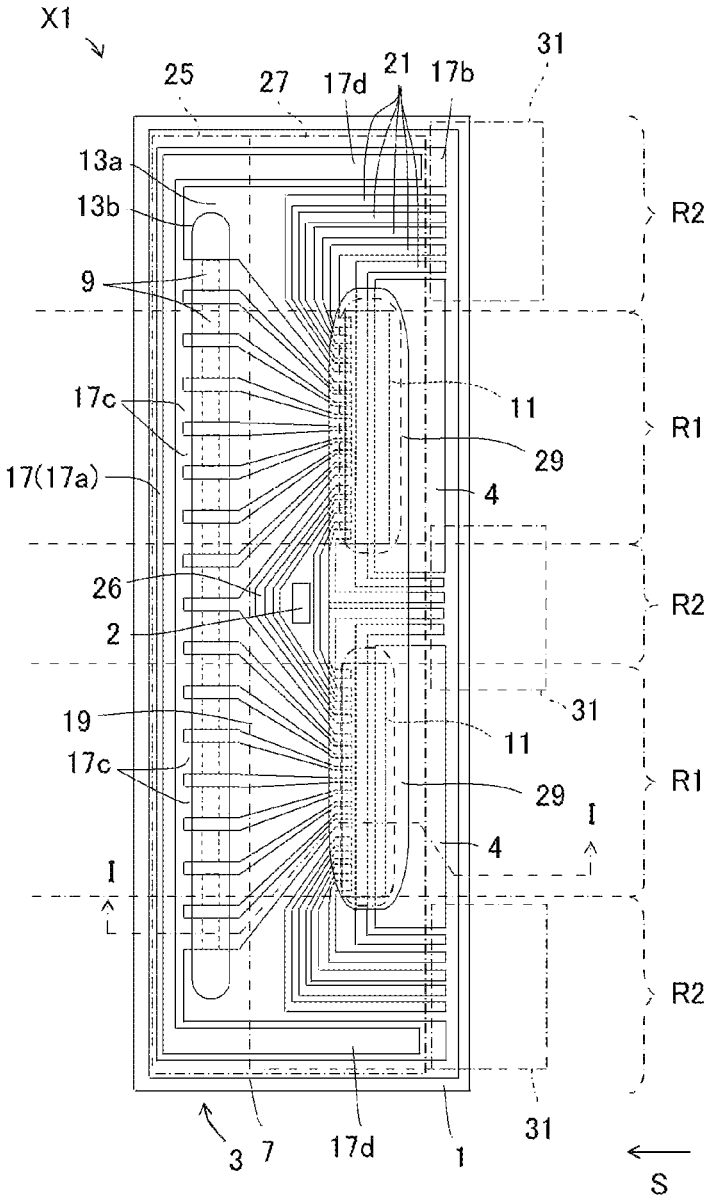
FIG. 1 is a plan view showing a first embodiment of a thermal head according to the invention.

Hereinafter, a thermal head X1 will be described with reference to FIGS. 1 to 4. The thermal head X1 comprises: a heatsink 1; a head substrate 3 placed on the heatsink 1; and a connector 31 connected to the head substrate 3. In FIG. 1, the diagrammatic representation of the connector 31 is omitted, and, a region where the connector 31 is placed is indicated by alternate long and short dashed lines.

While the connector 31 will hereafter be described as a connecting member which makes external electrical connection, other members having flexibility such as a flexible printed wiring board, a glass epoxy substrate, or a polyimide substrate, can be used instead. In a case where external electrical connection is established by a flexible printed wiring board, a reinforcing plate made of resin such for example as a phenol resin, a polyimide resin, or a glass epoxy resin (not shown in the drawing) may be disposed between the flexible printed wiring board and the heatsink 1.

The heatsink 1 has the form of a plate, and, in a plan view, the heatsink 1 is rectangular-shaped. The heatsink 1 is formed of a metal material such for example as copper, iron, or aluminum, and has the capability of dissipating, of heat generated by a heat generating portion 9 of the head substrate 3, heat which is not responsible for printing. Moreover, the head substrate 3 is bonded to the upper surface of the heatsink 1 by means of double-faced tape, an adhesive, or otherwise (not shown).

In a plan view, the head substrate 3 has the form of a plate, and, constituent members of the thermal head X1 are each disposed on a substrate 7 of the head substrate 3. The head substrate 3 has the function of performing printing on a recording medium (not shown) in response to an electric signal issued from outside.

Figure 2:
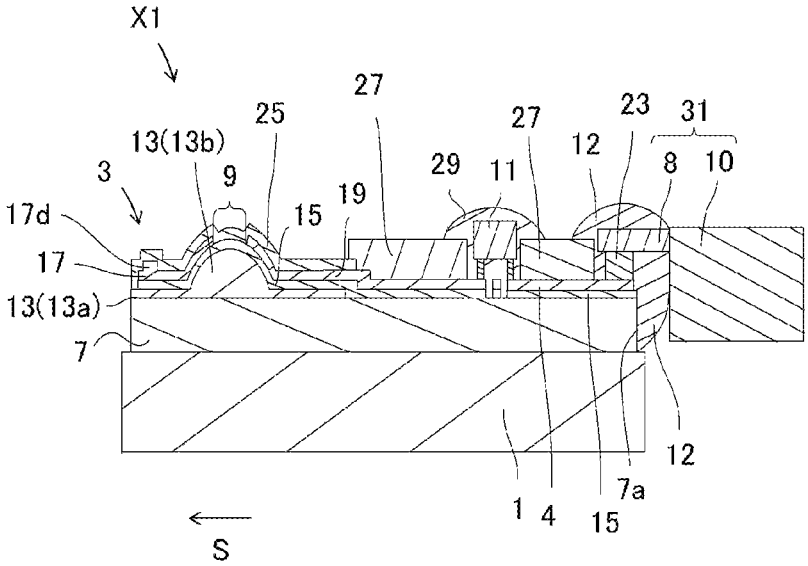
FIG. 2 is a sectional view taken along the line I-I shown in FIG. 1.

As shown in FIGS. 1 and 2, the connector 31 comprises: a plurality of connector pins 8; and a housing 10 which accommodates the plurality of connector pins 8. The plurality of connector pins 8 have one sides left exposed outside of the housing 10, and have other sides stored within the housing 10. The plurality of connector pins 8 have the function of ensuring electrical conduction between each of various electrodes of the head substrate 3 and an externally-disposed power supply, and are electrically independent of each other. The connector pins 8 are required to have electrical conductivity, and are therefore formed of a metal or an alloy.

The housing 10 has the function of accommodating the respective connector pins 8 in a state of being electrically independent of each other, and is therefore formed of an insulating member. The housing 10 effects supply of electricity to the head substrate 3 by means of attachment and detachment of an externally-disposed connector (not shown). The housing 10 is made of, for example, a thermosetting resin, an ultraviolet-curable resin, or a photo-curable resin.

Hereinafter, each of members constituting the head substrate 3 will be described.

The substrate 7 is formed of an electrically insulating material such as alumina ceramics, or a semiconductor material such as single-crystal silicon.

A heat storage layer 13 is formed on the upper surface of the substrate 7. The heat storage layer 13 comprises: an underlayer portion 13*a*; and a protuberant portion 13*b*. The underlayer portion 13*a* is formed over the left half of the upper surface of the substrate 7. The protuberant portion 13*b* extends in the form of a strip along a main scanning direction of a plurality of heat generating portions 9, and has a substantially semi-elliptical sectional profile. The underlayer portion 13*a* is disposed near the heat generating portion 9 while being located below a protective layer 25 which will hereafter be described. The protuberant portion 13*b* acts to press a recording medium which is subjected to printing against the protective layer 25 formed on the heat generating portion 9 in a satisfactory manner.

The heat storage layer 13 is formed of glass having a low heat conductivity, and accumulates part of heat generated by the heat generating portion 9 temporarily. Accordingly, the heat storage layer 13 is able to shorten the time required for a temperature rise in the heat generating portion 9, and thus acts to improve the thermal response characteristics of the thermal head X1.

For example, the heat storage layer 13 is formed by applying a predetermined glass paste, which is obtained by blending a suitable organic solvent in glass powder, onto the upper surface of the substrate 7 by means of heretofore known screen printing or otherwise, and subsequently firing the paste.

An electrical resistance layer 15 is disposed on the upper surface of the heat storage layer 13, and, on the electrical resistance layer 15 are disposed a ground electrode 4, a common electrode 17, an individual electrode 19, an IC-connector connection electrode 21, and an IC-IC connection electrode 26. The electrical resistance layer 15 is subjected to patterning so as to have the same shape as the ground electrode 4, the common electrode 17, the individual electrode 19, the IC-connector connection electrode 21, and the IC-IC connection electrode 26, and has an exposed region serving as an exposed electrical-resistance layer 15 region lying between the common electrode 17 and the individual electrode 19.

As shown in FIG. 1, there are arranged exposed regions of the electrical-resistance layer 15 in an array on the protuberant portion 13*b* of the heat storage layer 13, and, each of the exposed regions constitutes the heat generating portion 9. The plurality of heat generating portions 9, while being illustrated in simplified form in FIG. 1 for convenience in explanation, are arranged at a density of 100 dpi to 2400 dpi (dot per inch), for example. The electrical resistance layer 15 is formed of a material having a relatively high electrical resistance such for example as a TaN-based material, a TaSiO-based material, a TaSiNO-based material, a TiSiO-based material, a TiSiCO-based material, or a NbSiO-based material. Thus, upon application of a voltage to the heat generating portion 9, the heat generating portion 9 is caused to generate heat under Joule heating effect.

The ground electrode 4, the common electrode 17, the individual electrode 19, the IC-connector connection electrode 21, and the IC-IC connection electrode 26 are formed of a material having electrical conductivity, for example, one metal material selected from among aluminum, gold, silver, and copper, or an alloy of these metals.

The common electrode 17 comprises: a main wiring portion 17*a*; a sub wiring portion 17*b*; a lead portion 17*c*; and a thick electrode portion 17*d*. The main wiring portion 17*a* extends along one long side of the substrate 7. The sub wiring portion 17*b* extends along each of one and the other short sides of the substrate 7. The lead portion 17*c* extends from the main wiring portion 17*a* toward each of the heat generating portions 9. The thick electrode portion 17*d*, which is disposed on the main wiring portion 17*a* and the sub wiring portion 17*b*, is made thicker than the other portions of the common electrode 17. The common electrode 17 provides electrical connection between the connector 31 and each of the heat generating portions 9.

The thermal head X1 is configured so that an electric current fed from the sub wiring portion 17*b* located at each end thereof in the direction of arrangement of the heat generating portions 9 (hereafter also referred to as "main scanning direction") passes through the main wiring portion 17*a*, flows through each of the lead portions 17*c*, and is thereby supplied to each of the heat generating portions 9. On the main wiring portion 17*a*, as well as on the sub wiring portion 17*b*, there is provided the thick electrode portion 17*d* which acts to increase the current carrying capacity of the main wiring portion 17*a* and the sub wiring portion 17*b*. Exemplary of the thick electrode portion 17*d* is an Ag paste.

A plurality of individual electrodes 19 provide electrical connection between each of the heat generating portions 9 and a driving IC 11. Moreover, given that the heat generating portions 9 are bunched together in groups, the individual electrodes 19 allow the heat generating portions 9 in each group to make electrical connection with a corresponding one of the driving ICs 11 prepared for the heat generating portion groups, respectively.

A plurality of IC-connector connection electrodes 21 have one ends connected to the driving IC 11 and have other ends led out to an end face 7*a* of the substrate 7. The led-out ends are electrically connected to the connector 31, thereby permitting electrical connection between the driving IC 11 and the connector 31. The plurality of IC-connector connection electrodes 21 connected to each of the driving IC 11 are configured by a plurality of wiring lines having different functions.

The ground electrode 4, which is placed between the IC-connector connection electrode 21 and the main wiring portion 17*a* of the common electrode 17, has a large area. The ground electrode 4 is grounded and maintained at a potential of 0 to 1 V.

A plurality of IC-IC connection electrodes 26 provide electrical connection between the driving ICs 11 arranged adjacent each other. The plurality of IC-IC connection electrodes 26 are disposed in correspondence to the IC-connector connection electrodes 21, and transmit various signals to the adjacent driving ICs 11. That is, an electric current is fed from the connector 31 to the driving IC 11 by way of the IC-connector connection electrodes 21 and the IC-IC connection electrodes 26.

As shown in FIG. 1, the driving IC 11 is placed in correspondence to each of the groups including the plurality of heat generating portions 9, and is connected to the individual electrode 19, the IC-connector connection electrode 21, and the ground electrode 4. The driving IC 11 has the function of controlling the current-carrying state of each of the heat generating portions 9. It is advisable to use a switching member having a plurality of built-in switching elements as the driving IC 11.

As shown in FIG. 1, in a sub scanning direction S coincident with a conveying direction S in which a recording medium (not shown) is conveyed, in the thermal head X1, the substrate 7 comprises a first region R1 and a second region R2 in a plan view, the first region R1 being defined by extending an area where the driving IC 11 is disposed in the sub scanning direction and the second region R2 being an area other than the first region R1.

The first region R1 has a width which is equal to the width of the driving IC 11 in the main scanning direction, and extends along the sub scanning direction S while maintaining the width. In other words, in a plan view, the first region R1 is a region defined by virtual lines extending in the sub scanning direction S along side faces of the driving IC 11 that are perpendicular to the main scanning direction.

The electrical resistance layer 15, the common electrode 17, the individual electrode 19, the ground electrode 4, the IC-connector connection electrode 21, and the IC-IC connection electrode 26 thus far described are formed by, for example, stacking layers of their constituent materials on the heat storage layer 13 one after another by a heretofore known thin-film forming technique such as a sputtering method, and subsequently working the resultant layered body into predetermined patterns by a heretofore known technique such as a photo-etching method. Note that the common electrode 17, the individual electrode 19, the ground electrode 4, the IC-connector connection electrode 21, and the IC-IC connection electrode 26 can be formed at one time through the same process steps. Meanwhile, the thick electrode portion 17*d* can be formed by means of printing before or after the process of working the different electrodes into predetermined patterns.

As shown in FIGS. 1 and 2, the protective layer 25 which covers the heat generating portion 9, part of the common electrode 17, and part of the individual electrode 19, is formed on the heat storage layer 13 formed on the upper surface of the substrate 7. In FIG. 1, for convenience in explanation, a region where the protective layer 25 is formed is indicated by alternate long and short dashed lines, and its diagrammatic representation is omitted.

The protective layer 25 is intended to protect the covered areas of the heat generating portion 9, the common electrode 17, and the individual electrode 19 against corrosion caused by adhesion of, for example, atmospheric water content, or against wear caused by contact with a recording medium which is subjected to printing.

The protective layer 25 can be formed from SiN, SiO, SiON, SiC, SiCN, diamond-like carbon, or the like, and, the protective layer 25 may either be of a single layer or be composed of a stack of layers. Such a protective layer 25 can be produced by a thin-film forming technique such as the sputtering method, or a thick-film forming technique such as a screen printing method.

Moreover, as shown in FIGS. 1 and 2, a cover layer 27 which partly covers the ground electrode 4, the common electrode 17, the individual electrode 19, and the IC-connector connection electrode 21 is disposed on the substrate 7. In FIG. 1, for convenience in explanation, a region where the cover layer 27 is formed is indicated by alternate long and short dashed lines.

The cover layer 27 is intended to protect the covered areas of the ground electrode 4, the common electrode 17, the individual electrode 19, the IC-IC connection electrode 26, and the IC-connector connection electrode 21 against oxidation caused by contact with air, or corrosion caused by adhesion of atmospheric water content, for example.

In order to provide more secure protection for the common electrode 17 and the individual electrode 19, as shown in FIG. 2, it is preferable that the cover layer 27 is so formed as to overlie an end part of the protective layer 25. The cover layer 27 can be formed from a resin material such for example as an epoxy resin or a polyimide resin using a thick-film forming technique such as the screen printing method.

The cover layer 27 is formed with an opening (not shown) for leaving the individual electrode 19, the IC-IC connection electrode 26, and the IC-connector connection electrode 21 connected to the driving IC 11 exposed, so that the wiring lines can be connected to the driving IC 11 through the opening. Moreover, the driving IC 11 is, in a state of being connected to the individual electrode 19, the IC-IC connection electrode 26, and the IC-connector connection electrode 21, covered with a covering member 29 formed of resin such for example as an epoxy resin or a silicone resin for the sake of protection of the driving IC 11 and also protection of the area of connection between the driving IC 11 and the wiring lines. In the present embodiment, the covering member 29 is disposed so as to straddle over a plurality of driving ICs 11. The height of the cover layer 27 from the substrate 7 can be determined as appropriate in accordance with the form of the thermal head X1, and, a desirable range of the height is from 200 to 500 μm.

As shown in FIG. 2, at that side of the cover layer 27 located toward the end face 7*a* of the main surface (not shown) of the substrate 7, the ends drawn from the different electrodes are exposed from an exposed area where the different electrodes are left exposed (not shown) so as to be electrically connected to the connector 31.

The connector 31 is disposed on the substrate 7, and, the connector pin 8 is electrically connected to the led-out ends of the different electrodes by an electrically-conductive member 23. In the thermal head X1, the connector 31 is disposed at each of the opposite ends and the midportion of the thermal head X1 in the main scanning direction. Exemplary of the electrically-conductive member 23 are solder and an anisotropic conductive adhesive obtained by blending conductive particles in an electrically insulating resin. Note that a Ni-, Au-, or Pd-plating layer (not shown) may be disposed between the electrically-conductive member 23 and the led-out ends of the different electrodes.

The thermal head X1 is provided with a protecting member 12 which protects, at least partly, the connector 31. The protecting member 12 is disposed so as to cover the connector pin 8, part of the upper surface of the housing 10, and part of the cover layer 27, as well as to cover the exposed area completely when seen in a plan view.

The protecting member 12 can be formed of a thermosetting resin, a thermosoftening resin, an ultraviolet-curable resin, or a visible light-curable resin, for example. Moreover, in a case where the different electrodes need to be electrically independent of each other, it is preferable that the protecting member 12 has an electrically insulating property.

Moreover, the protecting member 12 covers the connector pin 8 of the connector 31 which assures the electrical conduction, and, preferably, the protecting member 12 is disposed also on part of the upper surface of the housing 10. By doing so, the connector pin 8 can be entirely covered with the protecting member 12, thereby assuring the electrical conduction more positively.

Figure 3:
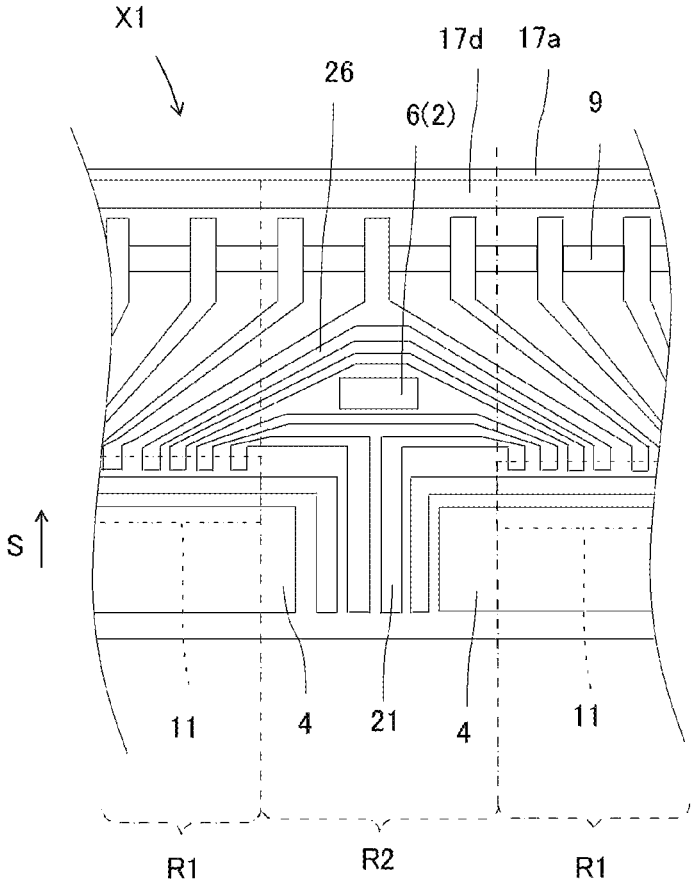
FIG. 3 is an enlarged plan view of a vicinity of a projection portion of the thermal head shown in FIG. 1.
Figure 4:
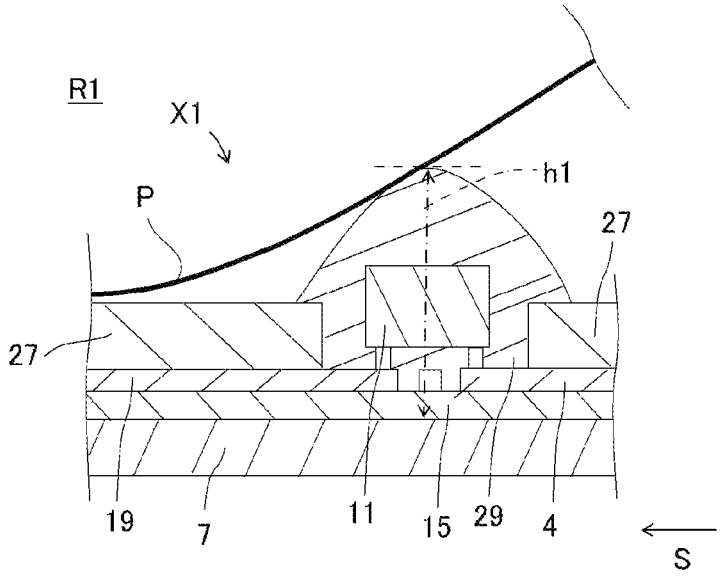
FIG. 4 is a conceptual diagram illustrating a condition of contact between a recording medium and the thermal head shown in FIG. 1, wherein FIG. 4(*a*) shows the vicinity of a driving IC, and FIG. 4(*b*) shows the vicinity of the projection portion.
Figure 4:
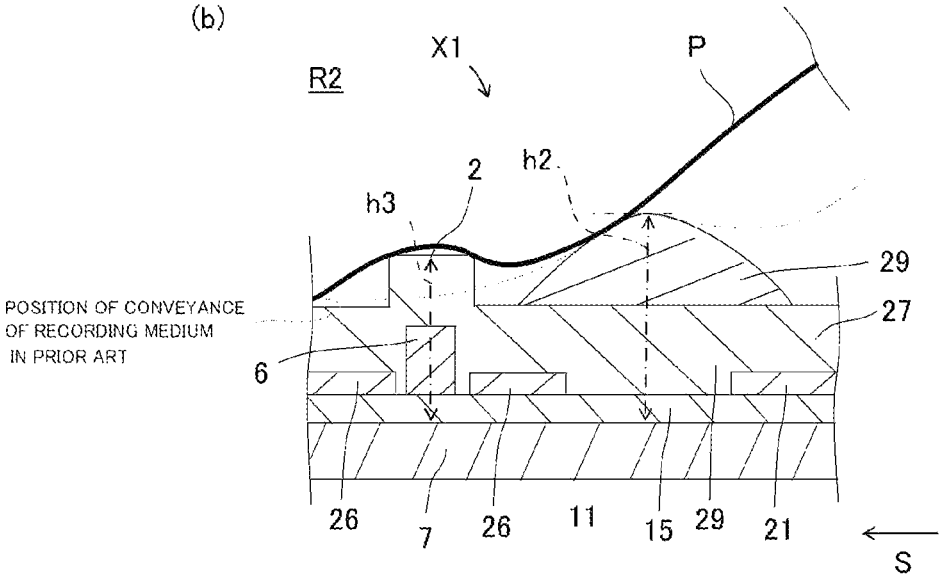

Referring to FIGS. 3 and 4, a projection portion 2 will be described in detail. FIG. 3 shows the vicinity of the projection portion 2 in an enlarged manner, and FIG. 4 is a conceptual diagram illustrating a condition of contact between a recording medium P and the covering member 29, as well as the projection portion 2. A solid line drawn in FIGS. 4(*a*) and 4(*b*) indicates a position of conveyance of the recording medium P in the present embodiment, whereas a broken line drawn in FIG. 4(*b*) indicates a position of conveyance of the recording medium P in a case where the projection portion 2 is assumed to be absent.

As shown in FIG. 3, the projection portion 2 is disposed at a center of the substrate 7 in the main scanning direction so as to lie in the second region R2. Moreover, the projection portion 2 is disposed in a position spaced downstream from the driving IC 11 in the conveying direction S of the recording medium P. Furthermore, the projection portion 2 is disposed on the second region R2 closer to the heat generating portion 9 than the area where the driving IC is disposed.

The IC-connector connection electrode 21 and the IC-IC connection electrode 26 are arranged around the projection portion 2, and thus the projection portion 2 is placed so as to be surrounded by the IC-connector connection electrode 21 and the IC-IC connection electrode 26.

As shown in FIG. 4, a convexity 6 is disposed below the projection portion 2, and, the cover layer 27 is situated over the convexity 6. The cover layer 27 covers not only the convexity 6, but also the vicinity of the convexity 6. Thus, the projection portion 2 is composed of the convexity 6 and the cover layer 27. Note that the convexity 6 is disposed so as not to make contact with the IC-connector connection electrode 21 and the IC-IC connection electrode 26. That is, the convexity 6 is electrically isolated from the IC-connector connection electrode 21 and the IC-IC connection electrode 26.

The convexity 6 can be formed of a material similar to the material constituting the thick electrode portion 17*d*. Moreover, the convexity 6 can be formed by means of printing. Therefore, by forming the convexity 6 concurrently with the formation of the thick electrode portion 17*d*, it is possible to achieve shortening of takt time, and thereby increase the manufacturing efficiency. Note that the convexity 6 may also be formed by raising part of the substrate 7.

It is preferable that the height of the convexity 6 from the substrate 7 falls in the range of 15 to 30 μm. The projection portion 2 has a rectangular shape when seen in a plan view, and its height h3 from the substrate 7 preferably falls in the range of 40 to 70 μm. Moreover, the projection portion 2 is preferably given a surface roughness greater than the surface roughness of other area of the cover layer 27 than the projection portion 2. This makes it possible to render the recording medium P less slippery, and thereby improve the condition of intimate contact between the projection portion and the recording medium under conveyance.

A height h1 of the covering member 29 from the substrate 7 in the first region R1 is greater than a height h2 of the covering member 29 from the substrate 7 in the second region R2. This is ascribable to the presence or absence of the driving IC 11 located in a lower part of the covering member 29. Note that the height h1, h2 of the covering member 29 from the substrate 7 refers to the level of the vertex of the covering member 29 situated above the driving IC 11, namely the height of that part of the covering member which is contacted by the recording medium P from the substrate 7.

It is preferable that the height h1 of the covering member 29 from the substrate 7 falls in the range of 300 to 500 μm. Moreover, the height h2 of the covering member 29 from the substrate 7 preferably falls in the range of 200 to 400 μm. This makes it possible to support the conveyance of the recording medium P.

In measurement of height from the substrate 7, for example, with use of a contact type or non-contact type surface roughness meter, a distance from a reference point can be measured. For example, the vertex of the protuberant portion 13*b* of the heat storage layer 13 can be defined as the reference point. The surface roughness of the projection portion 2 and that of the cover layer 27 can be also measured by a similar method.

Among various members constituting the thermal head X1, and, particularly among the members disposed on the substrate 7, the driving IC 11 has a noticeably large size. Therefore, the level of the surface of that part of the thermal head X1 which is provided with the driving IC 11 and the level of the surface of that part of the thermal head X1 which is free of the driving IC 1 differ greatly from each other.

Also in the case where the covering member 29 is so disposed as to straddle over the plurality of driving ICs 11 as shown in FIG. 1, the first region R1 is greater in height than the second region R2. The recording medium P is conveyed while making contact with the covering member 29, and, in the first region R1, the recording medium P is maintained at a predetermined level under the support of the covering member 29.

However, in a conventional thermal head devoid of the projection portion 2, since the height h1, h2 of the covering member 29 from the substrate 7 varies depending on the presence or absence of the driving IC 11 located in a lower part thereof, it follows that the condition of conveyance of the recording medium P in the first region R1 differs from that in the second region R2. That is, in the second region R2, as indicated by the chain-dotted line shown in FIG. 4(*b*), the recording medium P may sag down, which leads to a difference in recording medium P-to-covering member 29 distance between the first region R1 and the second region R2. Therefore, the first region R1 and the second region R2 differ from each other in the condition of conveyance of the recording medium P. This gives rise to the possibility of causing wrinkles in the recording medium P which is being carried over the second region R2.

In contrast, in the thermal head X1, the projection portion 2 is disposed on the second region R2 closer to the heat generating portion 9 than the area where the driving IC 11 is disposed, and, the projection portion 2 can make contact with the recording medium P. Thus, as indicated by the solid line in FIG. 4(*b*), the projection portion 2 is able to lift up the sagging recording medium P. This makes it possible to restrain the recording medium P against sagging motion, and thereby render the condition of conveyance of the recording medium P approximately uniform, wherefore the possibility of causing wrinkles in the recording medium P can be decreased.

Moreover, since the recording medium P makes contact with the covering member 29 and the projection portion 2, the recording medium P is supported at two points. Therefore, even if the covering member 29 and the projection portion 2 are subjected to a stress when pressed by the recording medium P, the stress can be dispersed.

Moreover, in the process of performing sputtering of the protective layer 25, there may be a case where a plurality of thermal heads X1 are stacked while being displaced from each other by a predetermined distance so that their protective layers 25 can be formed at one time. In this case, the projection portion 2 acts to decrease the possibility of causing damage to the electrodes and so forth due to the overlapping arrangement of the thermal heads X1. More specifically, at the time of stacking the thermal heads X1 one upon another, by placing each thermal head X1 on the projection portion 2, a space can be formed between the stacked thermal heads X1. This space helps protect the electrodes and so forth.

Moreover, the projection portion 2 is placed in a position spaced downstream from the driving IC 11 in the conveying direction S of the recording medium P. Accordingly, the recording medium P is brought into contact with the projection portion 2 after making contact with the covering member 29 located above the driving IC 11. Thus, the recording medium P can be stably supported by the covering member 29, and also, the recording medium P in a state of sagging down in a region between the driving IC 11 and the heat generating portion 9 can be upheld at a predetermined level by the projection portion 2. As a result, the recording medium P can be conveyed smoothly to the heat generating portion 9.

Moreover, since the projection portion 2 is located between the covering member 29 and the heat generating portion 9, it follows that the recording medium P is brought into contact with the projection portion 2 after making contact with the covering member 29. Accordingly, the recording medium P which is being carried toward the heat generating portion 9 can be upheld at a predetermined level, with consequent accomplishment of smooth conveyance of the recording medium P to the heat generating portion 9. In addition, the projection portion 2 ensures more stable conveyance of the recording medium P to the heat generating portion 9.

The height h3 of the projection portion 2 from the substrate 7 is shorter than the height h1, h2 of the covering member 29 from the substrate 7. Thus, the recording medium P is supported by the taller covering member 29, thereby achieving stable conveyance of the recording medium P. This is because the covering member 29 is greater in volume and strength than the projection portion 2.

Moreover, in the conveying direction S, the height h3 of the projection portion 2 located on the downstream side from the substrate 7 is shorter than the height h2 of the driving IC 11 located on the upstream side in the second region R2 from the substrate 7. Accordingly, also in the second region R2, the recording medium P can be supported by the covering member 29, and the projection portion 2 is able to convey the recording medium P smoothly to the heat generating portion 9.

Moreover, it is preferable that the distance between the projection portion 2 and the heat generating portion 9 is 0.3 to 0.8 time the distance between the covering member 29 and the heat generating portion 9, and that the height h3 of the projection portion 2 from the substrate 7 is 0.05 to 0.3 time the height h1, h2 of the covering member 29 from the substrate 7.

By fulfilling the above prescribed ranges, it is possible to suppress an excessive increase in the area of contact between the recording medium P and the projection portion 2, and thereby permit adequate contact of the recording medium P with the projection portion 2. Accordingly, conveyance of the recording medium P can be effected satisfactorily. Moreover, it is more preferable that the distance between the projection portion 2 and the heat generating portion 9 is 0.4 to 0.6 time the distance between the covering member 29 and the heat generating portion 9, and that the height h3 of the projection portion 2 from the substrate 7 is 0.1 to 0.2 time the height h1, h2 of the covering member 29 from the substrate 7.

The distance between the covering member 29 and the heat generating portion 9 refers to a distance between the covering member 29 and the heat generating portion 9 arranged on a straight line extending along the sub scanning direction, and more specifically a distance between a side of the covering member 29 nearest the heat generating portion 9 and a virtual line extending along the main scanning direction while passing through the center of the heat generating portion 9.

For example, the condition of contact of the covering member 29 and the projection portion 2 with the recording medium P can be checked by the following method. To begin with, a coating of paint is applied to the surfaces of the covering member 29 and the projection portion 2, and then conveyance of the recording medium P is effected. Whether or not the covering member 29 and the projection portion 2 have made contact with the recording medium P can be checked by examining the presence or absence of the paint coating on the surfaces of the covering member 29 and the projection portion 2.

The projection portion 2 is, as exemplified, composed of the convexity 6 and the cover layer 27, but it is not so limited. For example, the projection portion 2 may be composed solely of the convexity 6 without providing the cover layer 27 over the convexity 6. In another alternative, the projection portion 2 may be formed by laminating several cover layers 27 one after another. In this case, the projection portion 2 can be composed solely of the cover layer 27.

Figure 5:
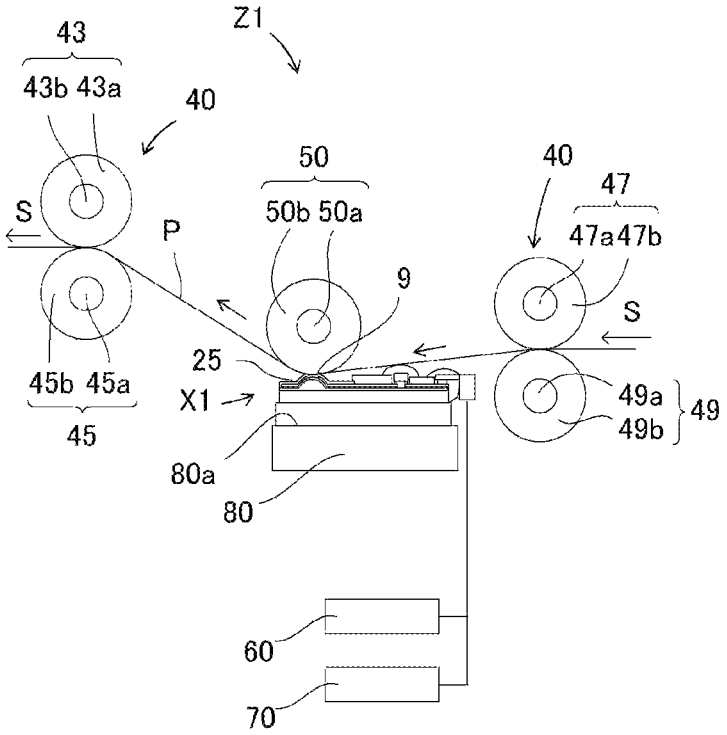
FIG. 5 is a view showing the general structure of the first embodiment of a thermal printer according to the invention.

Next, a thermal printer Z1 will be described with reference to FIG. 5. FIG. 5 is a view showing the general features of the thermal printer Z1, wherein the thermal head X1 is illustrated as being larger than its actual size.

As shown in FIG. 5, the thermal printer Z1 of the present embodiment comprises: the thermal head X1 thus far described; a conveyance mechanism 40; a platen roller 50; a power-supply device 60; and a control device 70. The thermal head X1 is attached to a mounting surface 80*a* of a mounting member 80 disposed in a casing (not shown in the drawing) for the thermal printer Z1.

The conveyance mechanism 40 comprises: a driving section (not shown); and conveying rollers 43, 45, 47, and 49. The conveyance mechanism 40 is intended to convey the recording medium P such as thermal paper or ink-transferable image-receiving paper in a direction indicated by arrow S shown in the drawing so that the recording medium P can be conveyed onto the protective layer 25 situated on the plurality of heat generating portions 9 of the thermal head X1. The driving section has the function of driving the conveying rollers 43, 45, 47, and 49, and, for example, a motor may be used as the driving section. The conveying roller 43, 45, 47, 49 can be constructed of, for example, a cylindrical shaft body 43*a*, 45*a*, 47*a*, 49*a* formed of metal such as stainless steel covered with an elastic member 43*b*, 45*b*, 47*b*, 49*b* formed of butadiene rubber or the like. Although not shown in the drawing, in a case where the recording medium P is ink-transferable image-receiving paper or the like, an ink film is interposed between the recording medium P and the heat generating portion 9 of the thermal head X1, and thus the recording medium P and the ink film are conveyed together.

The platen roller 50 has the function of pressing the recording medium P onto the protective layer 25 situated on the heat generating portion 9 of the thermal head X1. The platen roller 50 is disposed so as to extend along a direction perpendicular to the conveying direction S of the recording medium P, and is fixedly supported at its ends so that it is able to rotate while pressing the recording medium P onto the heat generating portion 9. For example, the platen roller 50 can be constructed of a cylindrical shaft body 50*a* formed of metal such as stainless steel covered with an elastic member 50*b* formed of butadiene rubber or the like.

The power-supply device 60 has the function of supplying electric current for allowing the heat generating portion 9 of the thermal head X1 to generate heat, as well as electric current for operating the driving IC 11. The control device 70 has the function of feeding a control signal for controlling the operation of the driving IC 11 to the driving IC 11 in order for the heat generating portions 9 of the thermal head X1 to generate heat in a selective manner.

In the thermal printer Z1, as shown in FIG. 5, the recording medium P is conveyed onto the heat generating portions 9 of the thermal head X1 by the conveyance mechanism 40 while being pressed onto the heat generating portions 9 by the platen roller 50, and, the heat generating portions 9 are caused to generate heat in a selective manner by the power-supply device 60 and the control device 70, whereby predetermined printing can be performed on the recording medium P. In a case where the recording medium P is image-receiving paper or the like, printing is performed on the recording medium P by effecting thermal transfer of the ink of an ink film (not shown) which is being conveyed together with the recording medium P onto the recording medium P.

<Second Embodiment>

Figure 6:
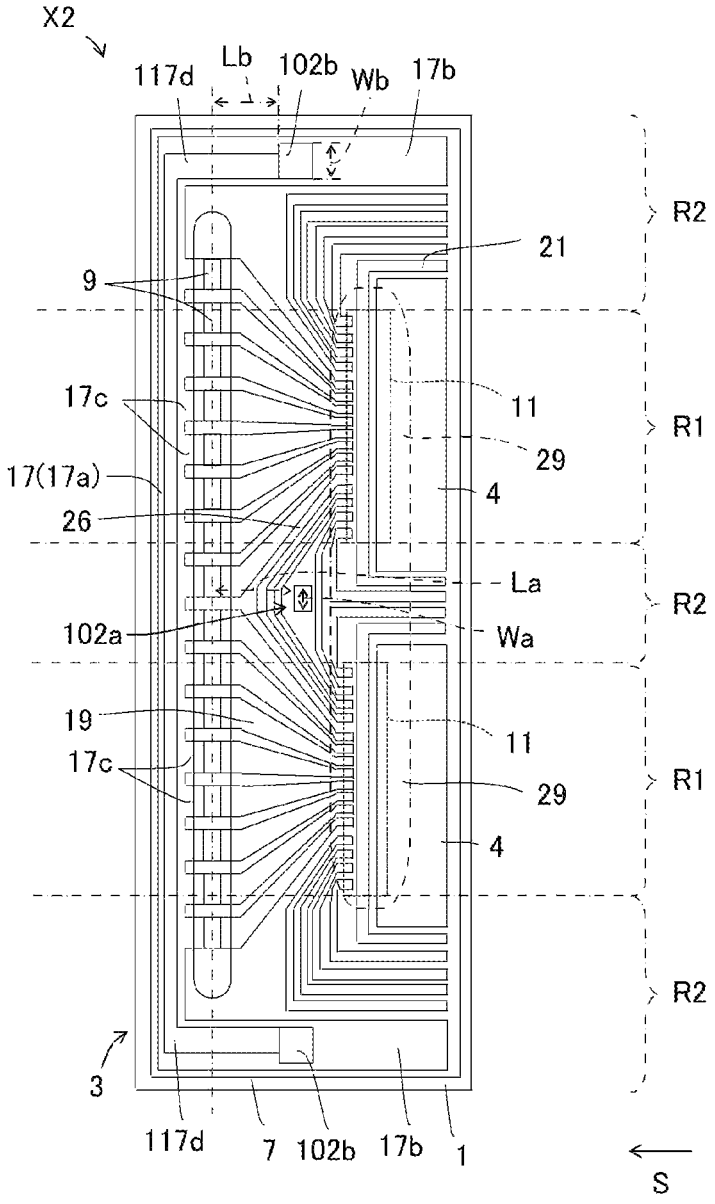
FIG. 6 is a plan view showing a second embodiment of the invention.

A thermal head X2 in accordance with a second embodiment will be described with reference to FIG. 6. FIG. 6 is a plan view showing an electrode pattern of the thermal head. The diagrammatic representations of the protective film, the cover layer, and the connector are omitted, and, the covering member 29 is indicated by alternate long and short dashed lines. In FIG. 6, except for a projection portion 102, the other constituent components are similar to those of the foregoing embodiment, and thus the description thereof will be omitted. In what follows, similar reference characters are used to denote like members.

The projection portion 102 comprises a first projection portion 102*a* and a second projection portion 102*b*. The first projection portion 102*a* is located at a center of the thermal head X2 in the main scanning direction, and has the same configuration as that of the projection portion 2 of the thermal head X1. The second projection portion 102*b* is located at each end of the thermal head X2 in the main scanning direction. The second projection portion 102*b* is formed integrally with a thick electrode portion 117*d* provided on a sub wiring portion 17*b*.

In this construction, printing is performed on the recording medium P in a state of being pressed against the thermal head X2 by the platen roller 50 (refer to FIG. 5). The platen roller 50 exhibits a greater pressing force at its ends than at other area in the main scanning direction, because the shaft body 50*a* of the platen roller 50 is fixed at its ends in the main scanning direction. Therefore, chances of occurrence of wrinkles in the recording medium P are increased in the second region R2 located at each end of the thermal head X2 in the main scanning direction.

However, in the thermal head X2, The projection portion 102 comprises the first projection portion 102*a* and the second projection portion 102*b*. Since the second projection portion 102*b* acts to support the recording medium P so as to restrain the recording medium P against sagging motion, it is possible to decrease the possibility of causing wrinkles in the recording medium P. Moreover, the second projection portion 102*b* also acts to lessen the pressing force of the platen roller 50, wherefore the pressing force distribution in the main scanning direction can be rendered approximately uniform.

The first projection portion 102*a* is placed in a region formed on the substrate 7 by extending the region bearing an array of the heat generating portions 9 in the sub scanning direction S. On the other hand, the second projection portion 102*b* is placed in a region other than the region formed on the substrate 7 by extending the region bearing an array of the heat generating portions 9 in the sub scanning direction S. Therefore, in the main scanning direction, the distance between the second projection portion 102*b* and the heat generating portion 9 is greater than the distance between the first projection portion 102*a* and the heat generating portion 9.

The thermal head X2 is configured so that a distance Lb between the heat generating portion 9 and the second projection portion 102*b* in the sub scanning direction is shorter than a distance La between the heat generating portion 9 and the first projection portion 102*a* in the sub scanning direction. Accordingly, the second projection portion 102*b* is located close to the heat generating portion 9, and is therefore able to support the recording medium P which is being carried in the vicinity of the heat generating portion 9. In this way, the recording medium P can be conveyed smoothly to the heat generating portion 9.

It is preferable that the distance La between the heat generating portion 9 and the first projection portion 102*a* falls in the range of 3 to 5 mm, and that the distance Lb between the heat generating portion 9 and the second projection portion 102*b* falls in the range of 2.5 to 4.5 mm. This makes it possible to support the recording medium P which is being conveyed in the vicinity of the heat generating portion 9.

Moreover, the thermal head X2 is configured so that a width Wb of the second projection portion 102*b* is greater than a width Wa of the first projection portion 102*a*. This makes it possible to increase the area of the second projection portion 102*b* when seen in a plan view which is subjected to a great pressing force exerted by the platen roller 50. Accordingly, the second projection portion 102*b* is able to lessen the pressing force of the platen roller 50, wherefore the possibility of causing wrinkles in the recording medium P can be decreased. Note that the width Wb of the second projection portion 102*b* coincides with the length of the second projection portion 102*b* in the main scanning direction, and the width Wa of the first projection portion 102*a* coincides with the length of the first projection portion 102*a* in the main scanning direction.

It is preferable that the width Wa falls in the range of 0.5 to 1.5 μm, and that the width Wb falls in the range of 2 to 6 μm. This makes it possible to suppress variations in the condition of conveyance of the recording medium P in the main scanning direction, and thereby decrease the possibility of causing wrinkles in the recording medium P.

Moreover, the thermal head X2 is configured so that the length of the second projection portion 102*b* in the sub scanning direction is greater than the length of the first projection portion 102*a* in the sub scanning direction. This makes it possible to increase the area of the second projection portion 102*b* when seen in a plan view which is subjected to a great pressing force exerted by the platen roller 50. Accordingly, the second projection portion 102*b* is able to lessen the pressing force of the platen roller 50, wherefore the possibility of causing wrinkles in the recording medium P can be decreased.

It is preferable that the length of the second projection portion 102*b* falls in the range of 1.5 to 2.5 μm, and that the length of the first projection portion 102*a* falls in the range of 0.5 to 1.5 μm. This makes it possible to suppress variations in the condition of conveyance of the recording medium P in the main scanning direction, and thereby decrease the possibility of causing wrinkles in the recording medium P.

It is noted that the distance La between the heat generating portion 9 and the first projection portion 102*a* in the sub scanning direction may be shorter than the distance Lb between the heat generating portion 9 and the second projection portion 102*b* in the sub scanning direction. In fact, in the process of forming various electrode patterns, there may be a case where a region capable of placement of the first projection portion 102*a* is smaller than a region capable of placement of the second projection portion 102*b*.

In this case, the first projection portion 102*a* cannot be made larger than the second projection portion 102*b*, wherefore the volume of an Ag paste forming the first projection portion 102*a* is smaller than the volume of an Ag paste forming the second projection portion 102*b*.

Accordingly, the first projection portion 102*a* is less heat storable than the second projection portion 102*b*, and can therefore be placed closer to the heat generating portion 9. As a result, the first projection portion 102*a* is able to convey the recording medium P smoothly to the heat generating portion 9.

Moreover, in the thermal head X2, the width Wa of the first projection portion 2 may be shorter than the width Wb of the second projection portion 2. In this case, the second projection portion 2 is able to lessen the pressing force of the platen roller 50 effectively, wherefore the possibility of causing wrinkles in the recording medium P can be decreased.

<Third Embodiment>

A thermal head X3 in accordance with a third embodiment will be described with reference to FIG. 7.

When the thermal head X3 is seen in a plan view, a projection portion 202 has a triangular shape. Moreover, in a plan view, two oblique sides thereof define inclined parts 214. The projection portion 202 is placed, with its base located on the upstream side in the conveying direction S. That is, the projection portion 202 is so shaped that its area when seen in a plan view becomes narrower gradually toward the downstream side in the conveying direction S. In other words, the projection portion 202 is so shaped that the area of contact with the recording medium P becomes narrower gradually in the same direction.

Thus, the projection portion 202 is so shaped that the area of contact with the recording medium P becomes narrower gradually toward the downstream side in the conveying direction S. This makes it possible to lessen a frictional force developed between the recording medium P and the projection portion 202, and thereby achieve smooth conveyance of the recording medium.

In particular, since the projection portion 202 has a triangular shape, and the two oblique sides thereof define the inclined parts 214, it is possible to achieve a gradual decrease in the area of contact between the recording medium P and the projection portion 202. Accordingly, the frictional force developed between the recording medium P and the projection portion 202 can be reduced gradually without causing a sharp decrease in the area of contact between the recording medium P and the projection portion 202. This helps decrease the possibility of occurrence of a sticking phenomenon.

It is sufficient that, when the substrate 7 is seen in a plan view, the inclined part 214 is inclined with respect to the sub scanning direction S, and, the angle which the inclined part 214 forms with the conveying direction S preferably falls in the range of 40 to 140°. Moreover, by configuring the projection portion 202 to have a triangular shape when seen in a plan view, it is possible to make efficient use of a space between the IC-IC connection electrodes 26, and thereby achieve downsizing of the thermal head X3.

Figure 7:
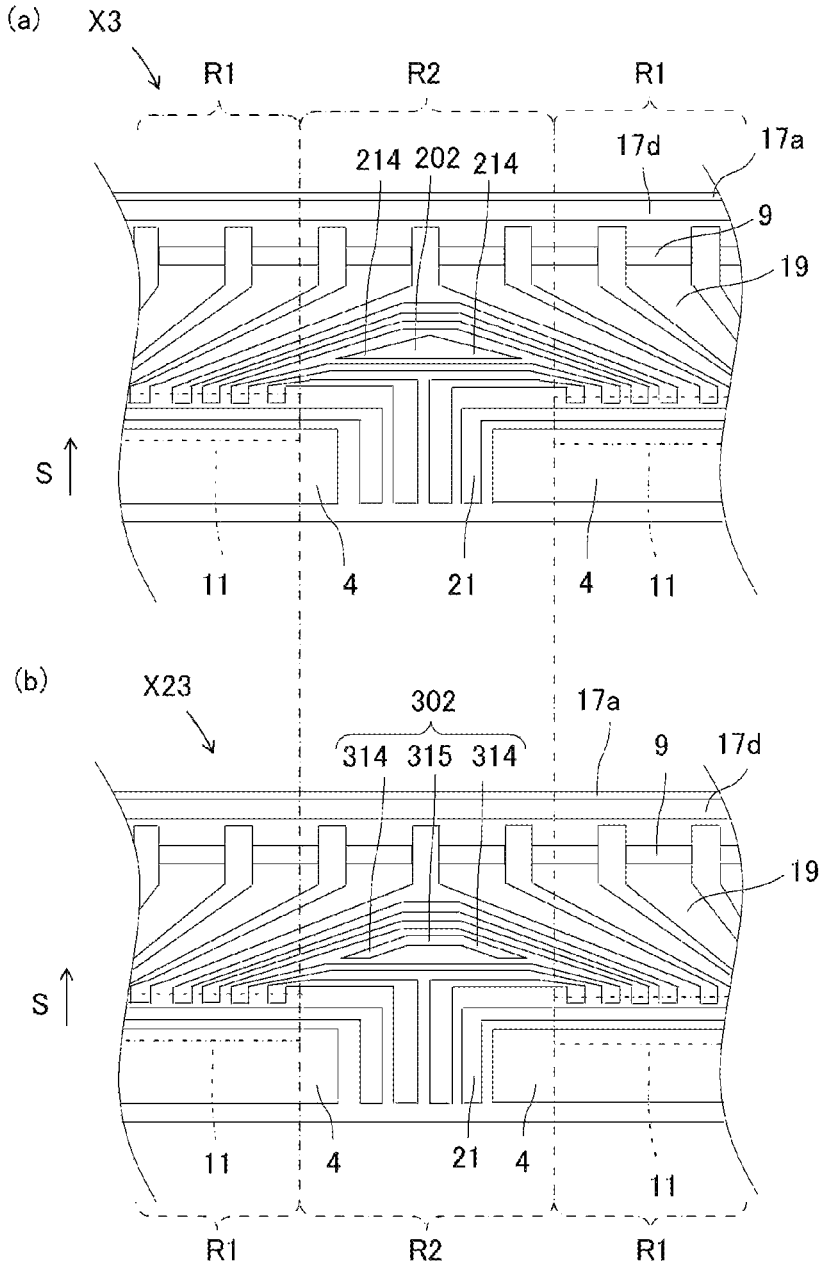
FIG. 7 shows a thermal head in accordance with a third embodiment of the invention, wherein FIG. 7(*a*) is an enlarged plan view of the vicinity of the projection portion, and FIG. 7(*b*) is a plan view showing a modified example of the thermal head shown in FIG. 7(*a*)

Referring to FIG. 7(*b*), a modified example of the thermal head X3 will be described. When the thermal head X3 is seen in a plan view, a projection portion 302 has a C-shape which is obtained by cutting a small trapezoid from a large trapezoid. The projection portion 302 comprises three sides, namely two oblique sides 314 and one side 315. A space surrounded by the two oblique sides 314 and the one side 315 is free of the projection portion 302.

The one side 315 is disposed along the main scanning direction, and, the inclined part 314 is located at each end of the one side 315. The angle which one of the inclined parts 314 forms with the one side 315 and the angle which the other one of the inclined parts 314 forms with the one side 315 are equal to each other. Accordingly, the configuration of the projection portion 302 is line-symmetrical about a centerline of the projection portion 302 in the main scanning direction.

The projection portion 302 is configured to support the recording medium P in a manner such that the sagging recording medium P can be upheld gradually from each end in the main scanning direction by the projection portion 302. Accordingly, as conveyance of the recording medium P proceeds, a central part of the recording medium P in the main scanning direction in a state of sagging down most deeply can be gradually lifted up by the projection portion 302. This makes it possible to smooth wrinkles while decreasing the possibility of occurrence of a large stress in the recording medium P without rapid elimination of wrinkles.

It is possible to dispose the IC-IC connection electrode 26 in the projection portion 302-free space surrounded by the two oblique sides 314 and the one side 315. That is, by providing the IC-IC connection electrode 26 in the space surrounded by the two oblique sides 314 and the one side 315, it is possible to increase the area of the IC-IC connection electrode 26, and thereby decrease interconnection resistance.

<Fourth Embodiment>

A thermal head X4 in accordance with a fourth embodiment will be described with reference to FIG. 8.

The thermal head X4 includes a third projection portion 402*a*, a fourth projection portion 402*b*, and a fifth projection portion 402*c*. Moreover, the projection portion 402 is disposed on each of the IC-IC connection electrodes 26 that are electrically independent of each other.

In the projection portion 402, the third projection portion 402*a*, the fourth projection portion 402*b*, and the fifth projection portion 402*c* are arranged sequentially in the order named from the upstream side in the conveying direction S. In a plan view, the third projection portion 402*a*, the fourth projection portion 402*b*, and the fifth projection portion 402*c* are rectangular-shaped and have substantially the same size.

In the projection portion 402, the recording medium P is brought into contact with the third projection portion 402*a*, the fourth projection portion 402*b*, and the fifth projection portion 402*c* one after another in the order named. It is therefore possible to smooth wrinkles gradually from the third projection portion 402*a* toward the fifth projection portion 402*c*. Moreover, the third projection portion 402*a*, the fourth projection portion 402*b*, and the fifth projection portion 402*c* are each disposed on the IC-IC connection electrode 26, wherefore the current carrying capacity of the IC-IC connection electrode 26 can be increased.

Moreover, the recording medium P is brought into contact with the projection portion 402 several times, wherefore a stress developed between the recording medium P and the projection portion 402 can be dispersed. Furthermore, since the third projection portion 402*a*, the fourth projection portion 402*b*, and the fifth projection portion 402*c* are disposed on their respective different IC-IC connection electrodes 26, it follows that the third projection portion 402*a*, the fourth projection portion 402*b*, and the fifth projection portion 402*c* are thermally independent of each other.

Accordingly, it is possible to increase the quantity of heat absorbed into the projection portion 402 from the recording medium P when the recording medium P is brought into contact with the projection portion 402. That is, in the case where the third projection portion 402*a*, the fourth projection portion 402*b*, and the fifth projection portion 402*c* are disposed on their respective different IC-IC connection electrodes 26, as compared with a case where the recording medium is brought into contact with the projection portion 402 in a single-piece form, improved heat dissipation capability can be attained.

While the thermal head X3 is, as exemplified, configured so that the third projection portion 402*a*, the fourth projection portion 402*b*, and the fifth projection portion 402*c* are disposed on their respective different IC-IC connection electrodes 26, alternatively, the third projection portion 402*a*, the fourth projection portion 402*b*, and the fifth projection portion 402*c* may be disposed on a single IC-IC connection electrode 26. Also in this case, the current carrying capacity of the IC-IC connection electrode 26 can be increased.

Figure 8:
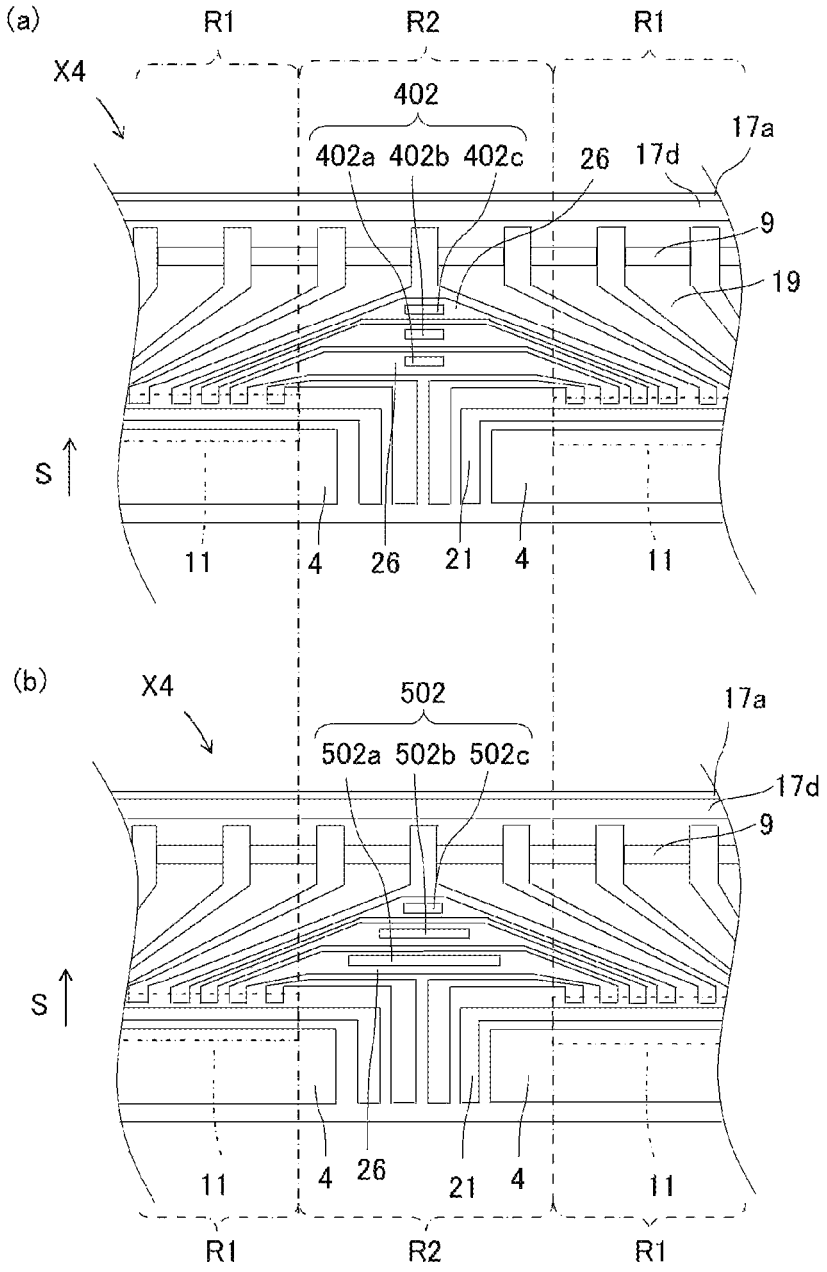
FIG. 8 shows a thermal head in accordance with a fourth embodiment of the invention, wherein FIG. 8(*a*) is an enlarged plan view of the vicinity of the projection portion, and FIG. 8(*b*) is a plan view showing a modified example of the thermal head shown in FIG. 8(*a*)

Referring to FIG. 8(*b*), a modified example of the thermal head X4 will be described. A projection portion 502 comprises a third projection portion 502*a*, a fourth projection portion 502*b*, and a fifth projection portion 502*c* that are arranged sequentially in the order named from the upstream side in the conveying direction S. In a plan view, the third projection portion 502*a*, the fourth projection portion 502*b*, and the fifth projection portion 502*c* are arranged in order of decreasing area.

Thus, the thermal head is configured so that the area of contact between the recording medium P and the projection portion 502 becomes smaller gradually from the upstream side in the conveying direction S. In this construction, the third projection portion 502*a* where the recording medium P is most strongly pressed against the projection portion 502, has the largest area of contact with the recording medium, and, the fourth projection portion 502*b* and the fifth projection portion 502*c* act to disperse a pressing force which diminishes gradually as the recording medium moves forward in the conveying direction S. As a result, the contacting area is adjusted in conformity with the pressing force exerted on the recording medium P, wherefore the recording medium P can be fed smoothly to the heat generating portion 9.

Moreover, in this construction, the fifth projection portion 502*c* has the smallest area of contact with the recording medium P, wherefore the frictional force developed between the fifth projection portion 502*c* and the recording medium P can be kept small. Accordingly, the recording medium P can be separated from the fifth projection portion 502*c* smoothly.

<Fifth Embodiment>

Figure 9:
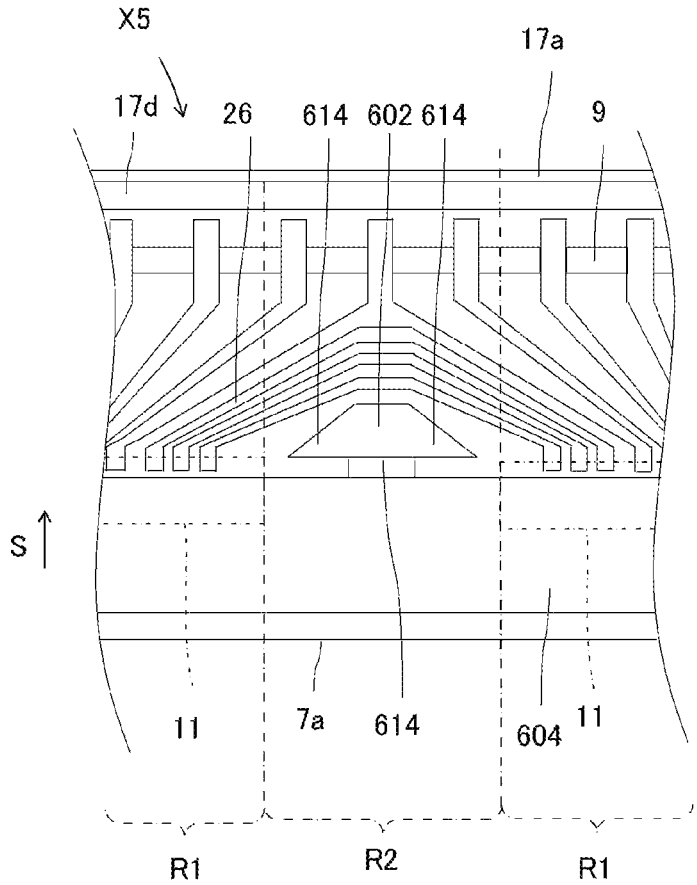
FIG. 9 is an enlarged plan view of the vicinity of the projection portion in a thermal head in accordance with a fifth embodiment of the invention.
Figure 10:
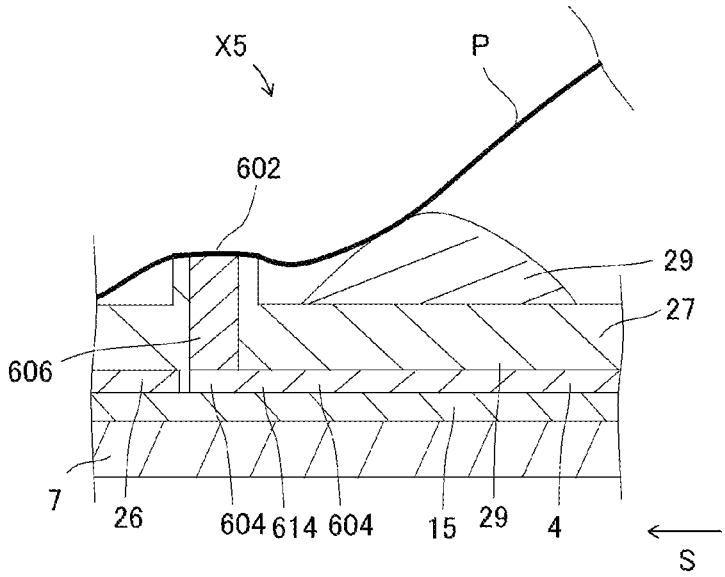
FIG. 10 is a conceptual diagram illustrating a contacting condition in the vicinity of the projection portion of the thermal head shown in FIG. 9.

A thermal head X5 implemented as the fifth embodiment will be described with reference to FIGS. 9 and 10.

The thermal head X5 differs from the thermal heads X1 to X4 in that a ground electrode 604 is disposed along the end face 7*a* of the substrate 7 so as to be surrounded by the end face 7*a* of the substrate 7, an IC-connector connection electrode 521, the individual electrode 19, and the IC-IC connection electrode 26.

A convexity 606 is disposed on the ground electrode 604. A ground electrode 604 disposed below the convexity 606 is electrically connected to the ground electrode 604 extending along the end face 7*a* of the substrate 7 via a coupling electrode 614. The convexity 606 has a trapezoidal shape when seen in a plan view, and is made of the earlier described Ag paste. Therefore, the convexity 606 has electrical conductivity, and is maintained at a ground potential.

The convexity 606 is disposed so as to protrude from the cover layer 27, and the upper surface of the convexity 606 is left exposed from the cover layer 27. That is, the projection portion 602 is configured to have the exposed convexity 606. The recording medium P under conveyance is brought into contact with the upper surface of the convexity 606 left exposed from the cover layer 27.

Thus, even if static electricity is generated in the recording medium P, it is possible to eliminate the static electricity through the projection portion 602 maintained at a ground potential that is contacted by the recording medium P. This makes it possible to decrease the possibility of causing electrostatic damage to the heat generating portion 9 or the recording medium P.

Moreover, it is advisable to apply a plating layer formed of Au, Ni, Pd, or the like onto the convexity 606 for suppressing corrosion of the convexity 606. This helps enhance the corrosion resistance of the convexity 606.

Furthermore, an electrically-conductive protective film (not shown) may be provided on the convexity 606. In this case, the convexity 606 and the electrically-conductive protective film constitute the projection portion 602.

While several embodiments of the invention have been described heretofore, it should be understood that the application of the invention is not limited to the embodiments thus far described, and that many modifications and variations of the invention are possible within the scope of the invention. For example, the thermal printer Z1 employing the thermal head X1 according to the first embodiment has been shown herein, but this does not suggest any limitation, and thus the thermal heads X2 to X5 may be adopted for use in the thermal printer Z1. Moreover, the thermal heads X1 to X5 according to several embodiments may be used in combination.

Moreover, the process of printing an Ag paste has been described as a way to form the thick electrode portion 17*d* and the convexity 2 following the formation of various electrodes, but this does not suggest any limitation. For example, it is possible to print an Ag paste in a predetermined position prior to the formation of the electrical resistance layer 15, and subsequently form the electrical resistance layer 15 and various electrodes.

Moreover, in the thermal head X1, the protuberant portion 13*b* is formed in the heat storage layer 13, and the electrical resistance layer 15 is formed on the protuberant portion 13*b*, but this does not suggest any limitation. For example, the heat generating portion 9 of the electrical resistance layer 15 may be placed on the underlayer portion 13*b* of the heat storage layer 13 without forming the protuberant portion 13*b* in the heat storage layer 13. In another alternative, the heat storage layer 13 may be formed over the entire area of the upper surface of the substrate 7. Also in this case, the protecting member 12 finds its way through the second exposed part 16 to the surface of the heat storage layer 13, wherefore the strength of adhesion between the substrate 7 and the protecting member 12 can be enhanced.

The protecting member 12 and the covering member 29 which covers the driving IC 11 may be formed of the same material. In this case, the covering member 29 and the protecting member 12 can be formed together at one time by performing printing also on the protecting member 12-forming region during the printing process for forming the covering member 29. Moreover, while the covering member 29 is, as exemplified, disposed so as to straddle over a plurality of driving ICs 11, the covering member 29 may be provided for each of the driving ICs on an individual basis. In this case, the difference in height between the first region R1 and the second region R2 becomes more noticeable, wherefore it is possible to utilize the invention efficiently.

Moreover, while the flat-type head in which the heat generating portion 9 is disposed on the main surface of the substrate 7 has been shown by way of exemplification, the invention is applicable to an edge-type head in which the heat generating portion 9 is disposed on the end face of the substrate 7. Furthermore, the invention may adopt a turned-back pattern in which adjacent heat generating portions 9 are connected to each other by a turned-back electrode (not shown).

Moreover, the driving IC 11 is, as exemplified, flip-chip mounted on the substrate 7, but this does not suggest any limitation. For example, the driving IC 11 may be disposed on the substrate 7 so as to be electrically connected to various electrodes by means of wire bonding. Moreover, the head substrate 3 may be electrically connected to an external substrate without providing the connector 31, and thus, also in a case where an external substrate having the driving IC 11 disposed on an upper surface thereof is abutted on the head substrate 3 so that the head substrate 3 and the external substrate can be juxtaposed, and then the driving IC 11 is electrically connected to various electrodes by means of wire bonding, it is possible to utilize the invention efficiently.

REFERENCE SIGNS LIST

X1-X5: Thermal head
Z1: Thermal printer
R1: First region
R2: Second region
1: Heatsink
2: Projection portion
3: Head substrate
4: Ground electrode
6: Convexity
7: Substrate
8: Connector pin
9: Heat generating portion
10: Housing
11: Driving IC
13: Heat storage layer
15: Electrical resistance layer
17: Common electrode
19: Individual electrode
21: IC-connector connection electrode
23: Electrically-conductive member
25: Protective layer
26: IC-IC connection electrode (IC connection electrode)
27: Cover layer
29: Covering member

The invention claimed is:

1. A thermal head, comprising:
a substrate;
a heat generating portion disposed on the substrate;
a driving IC disposed on the substrate and controlling actuation of the heat generating portion;
a covering member covering the driving IC; and
a projection portion disposed on the substrate and making contact with a recording medium under conveyance,
wherein the substrate comprises a first region and a second region in a plane view, the first region being defined by extending an area where the driving IC is disposed in a sub scanning direction and the second region being an area other than the first region,
wherein the projection portion is disposed on the second region closer to the heat generating portion than the area where the driving IC is disposed,
wherein the projection portion is separated from the covering member in a plan view.

2. The thermal head according to claim 1,
wherein a height of the projection portion is shorter than a height of the covering member.

3. The thermal head according to claim 1,
wherein a distance between the projection portion and the heat generating portion is 0.3 to 0.8 time a distance between the covering member and the heat generating portion, and
a height of the projection portion is 0.05 to 0.30 time a height of the covering member.

4. The thermal head according to claim 1,
wherein the substrate comprises an IC connection electrode providing electrical connection between a plurality of the driving ICs,
wherein the projection portion is disposed on the IC connection electrode.

5. The thermal head according to claim 1,
wherein the substrate comprises a ground electrode connected to the driving IC and an insulating layer covering the ground electrode,
wherein the projection portion is disposed on the ground electrode and exposed from the insulating layer.

6. The thermal head according to claim 1,
wherein a length of the projection portion in a main scanning direction becomes shorter gradually with increasing proximity to the heat generating portion.

7. The thermal head according to claim 6,
wherein the projection portion has a triangular shape in a plan view.

8. The thermal head according to claim 1,
wherein the projection portion comprises a third projection portion and a fourth projection portion situated on a downstream side with respect to the third projection portion in a direction in which the recording medium is conveyed, and
the fourth projection portion is smaller than the third projection portion in area in a plan view.

9. A thermal printer, comprising:
the thermal head according to claim 1;
a conveyance mechanism conveying the recording medium onto the heat generating portion; and
a platen roller pressing the recording medium onto the heat generating portion.

10. A thermal head, comprising:
a substrate;
a heat generating portion disposed on the substrate;
a driving IC disposed on the substrate,
a covering member covering the driving IC, and
a projection portion disposed on the substrate,
wherein the projection portion is between the heat generating portion and the covering member, wherein the projection portion is separated from the covering member.

11. The thermal head according to claim 10, wherein the driving IC comprises a first driving IC and a second driving IC, wherein the covering member comprises an covering area covering a region of the substrate between the first driving IC and the second driving IC, wherein the projection portion is between the heat generating portion and the covering area.

12. The thermal head according to claim 11, wherein a distance between the projection portion and the first driving IC and a distance between the projection portion and the second driving IC is equal.

13. The thermal head according to claim 10, wherein a height of the projection portion is shorter than a height of the covering member.

14. The thermal head according to claim 10, wherein the projection portion is separated from the heat generating portion.

15. A thermal head, comprising:

a substrate;

a heat generating portion disposed on the substrate;

a first driving IC and a second driving IC which are disposed on the substrate;

a covering member covering the first driving IC and the second driving IC; and a projection portion disposed on the substrate, wherein the covering member comprises an covering area covering a region of the substrate between the first driving IC and the second driving IC, wherein the projection portion is between the heat generating portion and the covering area.

* * * * *